US005585910A

United States Patent [19]

Jamzadeh et al.

[11] Patent Number: 5,585,910

[45] Date of Patent: Dec. 17, 1996

[54] IMAGE FORMING APPARATUS INCLUDING RELATIVELY STIFF RECEIVING SHEET CONTROL DEVICE

[75] Inventors: Feraydoon S. Jamzadeh, Fairport; James R. Flick; David J. Reed, both of Rochester, all of N.Y.

[73] Assignee: Eastman Kodak Company, Rochester, N.Y.

[21] Appl. No.: 281,332

[22] Filed: Jul. 27, 1994

[51] Int. Cl.[6] ..... G03G 21/00

[52] U.S. Cl. ..... 355/317; 355/271; 355/311; 355/315; 355/326 R

[58] Field of Search ..... 395/117; 355/315, 355/219, 271, 274, 276, 311, 326 R, 327, 275, 317

[56] References Cited

U.S. PATENT DOCUMENTS

| | | | |
|---|---|---|---|
| 4,466,729 | 8/1984 | Iwata | 355/274 X |
| 4,544,262 | 10/1985 | Kanemitsu et al. | 355/315 |
| 4,572,648 | 2/1986 | Toriumi et al. | 355/315 X |
| 4,769,670 | 9/1988 | Nishise | 355/315 |
| 4,875,069 | 10/1989 | Takada et al. | 355/326 R X |
| 5,068,693 | 11/1991 | Nagakura et al. | 355/315 |
| 5,075,734 | 12/1991 | Durland et al. | 355/326 R X |
| 5,406,358 | 4/1995 | Kimura et al. | 355/326 R X |
| 5,455,664 | 10/1995 | Ito et al. | 355/311 X |
| 5,459,819 | 10/1995 | Watkins et al. | 395/117 |

*Primary Examiner*—Shuk Yin Lee
*Attorney, Agent, or Firm*—Leonard W. Treash, Jr.

[57] ABSTRACT

An image forming apparatus is particularly usable with a relatively stiff receiving sheet. In one embodiment, it includes a transfer member around which the receiving sheet is attached. To maintain good contact between the receiving sheet and the transfer member, a pair of rollers are positioned to engage the receiving sheet in non-imaged margins to hold it intimately to the transfer member. The sheet may also be engaged at other positions in its path in the non-imaged margins to control its movement. In another embodiment, corona applied to the sheet before separation from the transfer member is specially biased to discourage premature or excessive separation because of the stiffness of the sheet. The bias can be then changed to encourage separation if a more flexible receiving sheet is used.

12 Claims, 2 Drawing Sheets

IMAGE FORMING APPARATUS INCLUDING RELATIVELY STIFF RECEIVING SHEET CONTROL DEVICE

This invention relates to the formation of toner images on a receiving sheet. Although not limited thereto, it is particularly usable in image forming apparatus in which toner images are formed on a difficult to handle receiving sheet, for example, a particularly stiff receiving sheet.

Electrostatic image forming apparatus commonly work with a limited range of stiffness of receiving sheets. Particularly stiff receiving sheets do not readily bend around comers in paper paths, nor do they attach easily to transfer drums. Very thin stock bends too easily and is also difficult to manage.

However, there are many uses for images formed on stiff receiving sheets, such as, 60 pound bond paper (225 grams per square meter). For example, U.S. Pat. No. 2,459,819, filed Apr. 22, 1994 to Watkins et, al which is a continuation-in-part of U.S. Pat. No. 5,530,793, filed Sep. 24, 1993, refers to a number of references which suggest the customization of greeting cards. In that application a number of images, including images scanned into a memory from an ordinary photograph or the like, are combined electronically by an operator to make a customized greeting card. Customized combined images can also be made by imaging an original prepared by cutting and pasting.

High quality, electrophotographic color copiers and printers presently on the market facilitate the combination of images and are suitable for forming toner images usable in the greeting card application. These printers have generally been designed for a more flexible receiving sheet, for example, a receiving sheet using 20 pound bond paper (75 grams per square meter). In a number of instances, the stiffness of the heavier sheet causes it to resist being fixed to a transfer drum or belt or moved around a curve in a path or causes it to shortcut a guide designed for use with the more flexible sheet.

SUMMARY OF THE INVENTION

It is an object of the invention to facilitate the use of a receiving sheet of unusual stiffness in an image forming apparatus.

According to one aspect of the invention, this and other objects are accomplished by image forming apparatus which includes means for forming a toner image on a receiving sheet with at least one margin along the image, preferably two margins on opposite sides of the image. The apparatus also includes means for fixing the toner image to the receiving sheet and means for moving the receiving sheet through a path in which it receives the toner image from the image forming means and passes through the image fixing means, through which path the margin or margins are parallel to the intrack movement of the sheet. The apparatus includes means for controlling the position of the sheet while in the path, which controlling means includes means for engaging the margin or margins.

According to a preferred embodiment of this aspect of the invention, the means for engaging includes two rollers and a shaft with the rollers positioned with respect to the path so that one roller engages each of opposite side margins. The engaging means, for example the shaft and two rollers, can be positioned to prevent a sheet because of its stiffness from engaging a portion of the apparatus a more flexible sheet would not engage. It can also be positioned to hold the receiving sheet against another member, for example, a transfer member, such as a transfer drum or belt. The margins are provided so that the engagement of the sheet does not disturb the toner image while still allowing the engagement of the toner side of the sheet.

According to a second aspect of the invention, which can be used independently of the first aspect, the image forming apparatus includes a transfer member, for example, a transfer drum or belt, to which a receiving sheet is held for the receipt of multiple toner images. A corona device is positioned to control the electrostatic attraction between the receiving sheet and the transfer member at unloading. With a stiff sheet the corona is designed to increase such attraction to hold the sheet to the transfer member more and make the sheet react like a more flexible sheet would react. That is, the stiff sheet is peeled off the transfer member similarly to the way a flexible sheet is peeled off.

According to a preferred embodiment of this second aspect, the corona device has two alternative conditions, a first condition in which it makes separation of the receiving sheet from the transfer member easier, and a second condition in which it discourages separation of the receiving sheet from the transfer member. The corona device is preferably used in its first condition in handling less stiff sheets, facilitating separation from the transfer member and overcoming a problem prevalent with more flexible receiving sheets. The second condition is used with more stiff receiving sheets to discourage premature separation of the leading or trailing end of the receiving sheet that may happen because of its stiffness.

According to a further preferred embodiment of this second aspect, the receiving sheets are receivable in the apparatus in a cartridge, which cartridge has a coding which sets the apparatus between its first and second conditions according to the type of receiving sheet in the cartridge.

According to a third aspect of the invention, stiff receiving sheets are made of "short grain" paper. "Short grain" paper is paper in which the grain is aligned across the short dimension of the sheet and is, therefore, somewhat more flexible when bent around an axis parallel to the short dimension of the sheet. This feature provides somewhat more flexibility to the sheet itself for following a path when the long dimension is parallel to the intrack direction of the path and the path has some curves or the sheet is wrapped around a transfer drum or belt having a curved aspect.

DETAILED DESCRIPTION OF THE INVENTION

Figure 1:
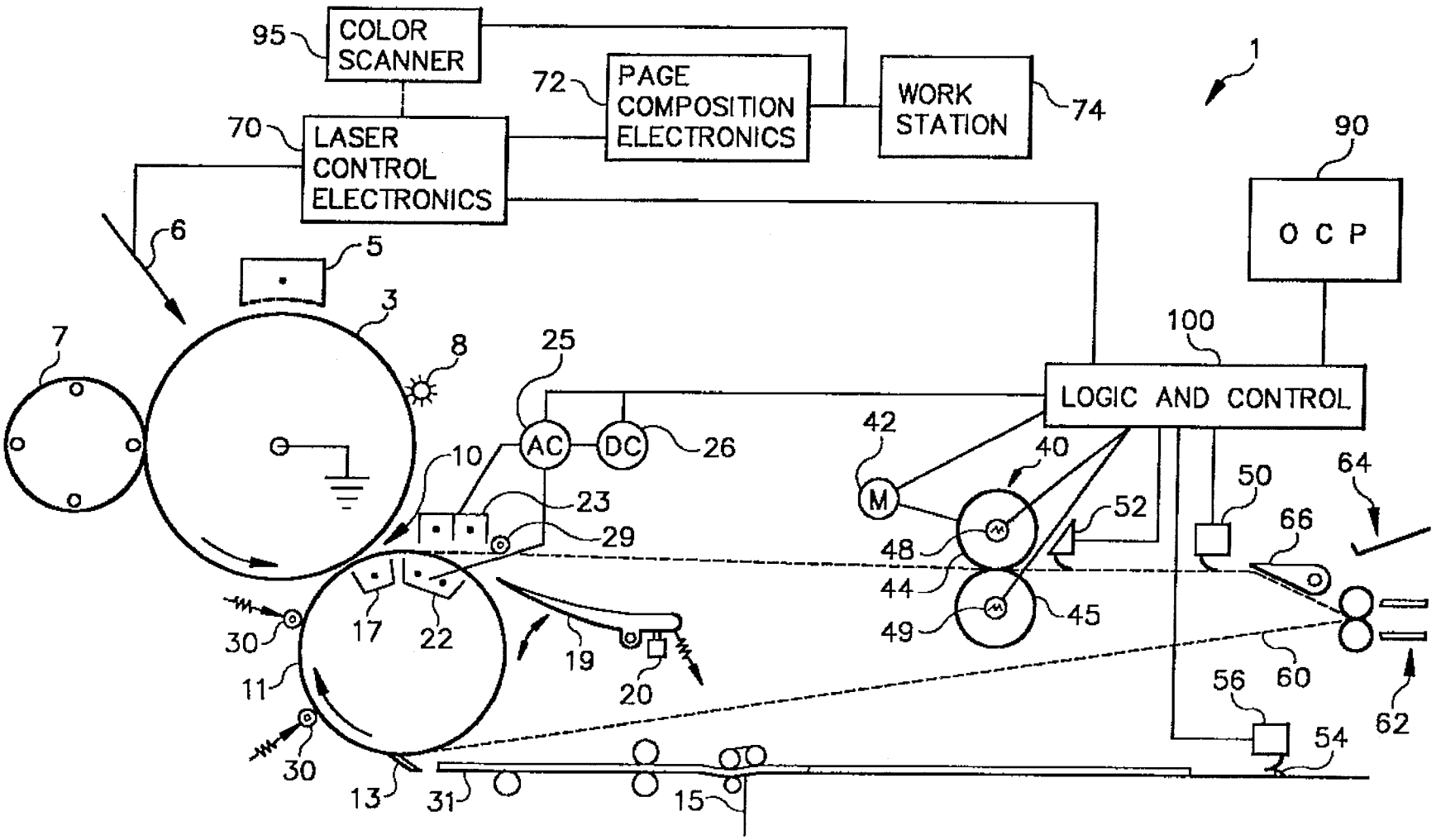
FIG. 1 is a schematic side view of an image forming apparatus.

Referring to FIG. 1, an image forming apparatus 1 includes an image member, for example, a photoconductive drum 3, on which toner images are formed conventionally. More specifically, the surface of drum 3 is uniformly charged by a charger 5 and imagewise exposed by exposing means, for example, a laser 6 to create a series of electrostatic images. Each of the electrostatic images is toned by the application of a different colored toner using a toning device 7 which contains four toning stations indexible through toning relation with image member 3.

At the same time, a receiving sheet 31 is fed from a receiving sheet supply 15 to the periphery of a transfer member 11. Transfer member 11 is shown as a drum, but could also be an endless belt, both of which are well known in the art for this application.

The leading edge of the receiving sheet 31 is gripped by a suitable holding means, for example, gripping fingers 13. A vacuum or electrostatics could also be used. As both the transfer drum 11 and the image member 3 are moved through a transfer nip at position 10, an electric field created by a transfer corona 17 or other field generating means transfers one of the toner images to the receiving sheet. As transfer member 11 is continually rotated, the series of different color toner images are transferred in registration to the receiving sheet to create a multicolor image on the sheet. After the desired number of transfers, the receiving sheet is separated from the transfer member 11 by a pivotable skive 19 which is moved into a position against transfer member 11 by a solenoid 20. Image member 3 is continually cleaned by a cleaning device 8 so that the process is continuous.

The receiving sheet 31 with the toner image on one side is now fed to a fuser 40 where a pair of fusing members 44 and 45, for example, conventional rollers internally heated by heaters 48 and 49, apply both pressure and heat to the image to at least partially fix it to the receiving sheet.

The receiving sheet can then be deposited in an output hopper 64. Alternatively, the receiving sheet is fed through a duplex path 60 which includes an inverter 62 back to the transfer member 11 to present the opposite side for receipt of a series of toner images, creating a second multicolor toner image on the reverse, second side of the receiving sheet. The sheet is again separated using separation skive 19 and fed again through the fuser 40 and into the output hopper 64.

Except for the automatic duplex mode of operation, the above very generally describes several different color image forming apparatus in commercial use today, for example, the Kodak ColorEdge 1550 Plus color copier. Duplex operation can be manually accomplished with these apparatus without the use of an internal duplex path.

U.S. Pat. No. 5,459,819 to Watkins et al, referred to above, describes a system for customized printing of a variety of articles with images obtained from a variety of different sources. In that system a photographic picture can be scanned and combined with graphics already in memory or composed on a screen and a typed in message to form a combined image using a printer also comparable to the color copier identified above. One of the applications suggested for this system is the formation of customized greeting cards in which a portion of an image can come from the scanning of a photograph, another portion can come frown suitable background or other graphics stored in memory particularly suitable to greeting cards, and still another portion can be typed in (or graphics composed) at a workstation. This patent application is hereby incorporated by reference herein.

In adapting an electrophotographic printer to the greeting card application and other applications comparable to that, we have made a number of improvements in known apparatus. Greeting card stock is typically much stiffer than the normal range of receiving sheet usable in a typical color copier or printer. For example, it may be as stiff as 60 pound paper. Referring to FIG. 1, this poses its greatest problem in wrapping the receiving sheet around a relatively small transfer member, such as drum 11. It also affects other aspect of movement of the receiving sheet and fusing of the images.

Figure 2:
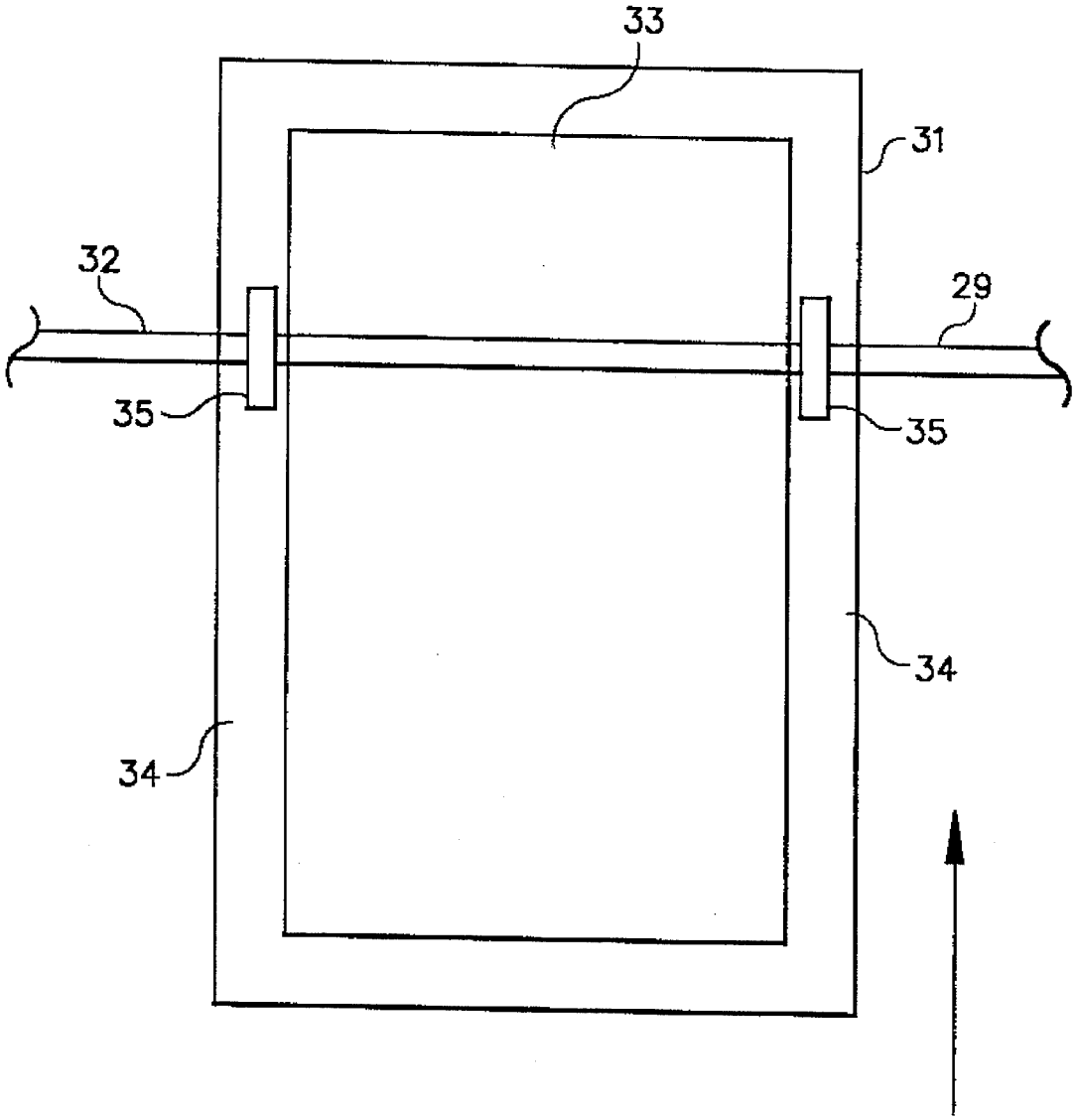
FIG. 2 is a top view of an image bearing receiving sheet and a receiving sheet engaging device.

Referring to FIG. 1, control of a stiff receiving sheet is assisted by first and second sheet engaging devices 29 and 30. Referring to FIG. 2, sheet engaging devices 29 and 30 (FIG. 1) preferably include a shaft 32 carrying a pair of rollers 35 which engage the toner side of the sheet in margins 34 designed to permit such engagement without adverse affect on a loose toner image. More specifically, a proposed toner image 33 is sized to fit on a receiving sheet 31 with significant margins 34 at each intrack side. Thus, if the receiving sheet is moved in the intrack direction of the arrow in FIG. 2, the rollers 35 can engage the toner side of the sheet in the margins 34 (generally parallel to the intrack direction) without disturbing toner image 33 which has not yet been fixed.

First sheet engaging device 29 is positioned just downstream of a set of corona chargers 23 (whose function will be described below). When a normal stiffness receiving sheet is separated by separation skive 19 from transfer member 11, it substantially follows the path of the upper surface of skive 19 toward fuser 40 because it is peeled off transfer member 11. However, a stiff receiving sheet has a tendency when separated by skive 19 to rotate upward toward corona charger 23. Any contact with charger 23 can disturb the image. Accordingly, first sheet engaging device 29 is positioned to intercept the leading portion of a stiff receiving sheet and prevent it from engaging charger 23. Because of the configuration of the image on the sheet providing margins 34, engaging device 29 does not affect the image. Engaging device 29 need not have a pair of rollers but could be stationary, non-rotatable guide pieces that are positioned to also engage margins 34.

It is important that the receiving sheet be firmly held to transfer member 11 for effective transfer by corona 17. Second sheet engaging devices 30 are positioned upstream of transfer corona 17 to urge the receiving sheet against transfer member 11 as it approaches the transfer area. Unlike the first sheet engaging device 29, the second sheet engaging device 30 is spring urged into contact with the transfer member.

It will be seen by someone skilled in the art that this principle could be applied in other places in the paper path of a stiff receiving sheet (or of a very flexible sheet). It should also be noted that it is known to use an endless belt for a transfer member, which endless belt generally traverses a path having sharper bends than does a transfer drum. A sheet engaging device such as device 30 is particularly useful in holding a stiff sheet to such a belt transfer member at its more curved turns.

Corona devices 22 and 23 are positioned to reduce electrostatic attraction of the receiving sheet to the transfer member 11 when a normal stiffness receiving sheet is used. With a normal, relatively flexible receiving sheet, separation of the sheet from the transfer member surface is difficult because of the strong electrostatic attraction between the sheet and the surface. An AC source 25 and a DC source 26 are used to essentially ground the two surfaces so that separation is easier.

However, when a stiff sheet is used, any immediate separation by the separation skive 19 is assisted by the beam strength of the sheet and the sheet has the tendency mentioned above of flapping up into the charger 23. At the trailing end of the sheet, separation can extend back into the transfer nip. It, thus, becomes desirable to attempt to hold the sheet to the transfer member rather than encourage its release. To effect this during the separation period, the AC corona is eliminated and a DC potential of the same polarity as the transfer corona 17 and of polarity opposite that of the toner image is applied by both chargers 22 and 23.

A logic and control 100 is programmed to provide this adjustment between the two conditions of the chargers 22 and 23.

It is known in the art to adjust conditions in an apparatus in response to code sensing on a cartridge. Paper supply 15 can be loaded by cartridge, with a machine readable coding 54 indicative of the stiffness of the receiving sheets in the cartridge. Coding 54 actuates a sensor 56 which signals logic and control 100 that stiff paper is in paper supply 15. Logic and control 100 then removes the AC voltage from the chargers 22 and 23 during separation of the sheet from transfer member 11 and inverts the polarity of the DC voltage applied by these chargers.

As described above, fuser 40 includes a first fusing member 44 which contacts the toner image to be fused and a second fusing member 45 which forms a heated pressure nip with the first fusing member 44. Both members are, in fact, rollers which are internally heated by a heating means 48 and 49. They are driven by a conventional motor 42 which has at least two speeds. Typically, a two speed motor is used in such fuser so that the fuser can be slowed for fusing transparency stock where more heat is necessary.

A heavier weight receiving sheet coming from transfer member 11 reduces the temperature in the nip upon contact with the rollers substantially more than a normal sheet of paper would reduce it. This effect is pronounced in paper receiving sheets in excess of 40 pound bond weight (150 grams per square meter), especially 60 pound (225 grams per square meter) stock or thicker. Typically, the reduction in temperature sends a signal to the logic and control 100 to apply heat through heating means 48 and 49 according to a program adapted to the particular fuser 40 being used. Using sensor 56, the amount of heat added and temperature set points can be adjusted for the heavier stock. However, there is a lag in the recovery that is quite substantial with a thick receiving sheet. In high gloss applications, preferable for color imaging, a substantial change in total heat added to the image shows up as a variation in gloss in the image. The reduction in temperature is most noticeable as the roller 44 completes one revolution. It shows up as an abrupt reduction in gloss which is quite noticeable.

This problem is alleviated by utilizing the two speed drive embodied in motor 42 to drive the fusing rollers 44 and 45 at a first speed for the first revolution of the fusing roller contacting the image, first roller 44. As the first roller 44 completes its first revolution after entry of the receiving sheet into the nip, the speed of the fuser is abruptly reduced to compensate for the now cooled portion of the fusing roller beginning to contact the toner image. The reduction in speed greatly increases the heat applied to the toner which compensates for the cooling of the surface by the first rotation in contact with the thick receiving sheet.

Timing can be accomplished in a number of ways. For example, a sensor 50 can be positioned a distance downstream of the nip equal to the circumference of first fusing roller 44. Actuation of the sensor 50 causes an immediate reduction in the speed of the motor 42. The reduction in speed could also be controlled in response to the abrupt reduction in temperature combined with knowledge of the rotation of roller 44. A preferred timing approach is to utilize a sensor 52 already in the nip to provide jam detection. The speed is then reduced a predetermined time after actuation of sensor 52. The time is, of course, dependent on the first speed and the circumference of roller 44.

If more than two revolutions of first fusing roller 44 are necessary to complete the fixing of the receiving sheet, the speed can again be reduced as the first fusing roller begins its third revolution. However, some compensation for the cooling of the surface by an increase in power to heating elements 48 and 49 takes effect by this time and such a further reduction in speed is not always necessary. In the preferred embodiment of the apparatus shown in FIG. 1, the receiving sheet is a ledger size sheet of 60 pound bond paper (225 grams per square meter), for example, 11×17 inches, with the intrack length being 17 inches. A 7 ½ inch circumference first fusing roller 44 would complete its second revolution two inches from the trailing edge of the sheet. Margins are provided at both the leading and trailing edges which in most instances is at least an inch at the trailing edge. We have found that it is not necessary with this apparatus to provide the second reduction in speed for consistent high quality images.

The speed of the fuser (both fast and slow) can be adjusted according to the weight of the paper. For example, the sensing device 56 can again be used to slow the fuser when going between regular 20 pound bond paper and 60 pound bond paper.

In using image forming apparatus 1 for making greeting cards, it is assumed that the copy after appropriate trimming will be folded. For example, it may be folded in the center, making a four page card which would commonly have greetings, messages and pictures on the first three pages. With the use of photos and other extensive broad coloring for such cards, it is common that one of the pages will have a substantially more dense image than the page adjacent it on the other side of the fold. It is desirable that the more dense portion of the image receive the most reliable heavy fusing to provide the gloss desired for it, as well as to make sure that toner stacks are fully fused. Reliability in this respect can be assisted by feeding the sheet into the fuser with the most dense portion leading. The most dense portion of the image then is less affected by the cooling of the fusing rollers from contact with the sheet. Such image orientation can be accomplished by rotating both images electronically or by hand at the composing stage.

In duplex copying with a receiving sheet path such as that shown in FIG. 1, a receiving sheet must pass through the fuser 40 twice. The first toner image passes through the fuser twice while the second toner image only passes through once. It is generally known to reduce the amount of heat used in the first passage, for example, by speeding up the fuser, to a minimum amount to allow the sheet to be handled without smearing of the image. The heat is then increased for the second pass to finish the fusing of the first image and complete the entire fusing of the second image.

This approach of applying less heat to the receiving sheet the first time through the fuser is usable in many applications. Its use will depend on the difficulty of smearing the image and the effect on the paper of having it pass through the fuser twice at the regular speed. It is not desirable in all applications, for example, it may not be desirable with color images because of the difficulty preventing smearing of substantial stack heights in color toner images.

In either case, the first image will receive more heat in its two passes through the fuser than will the second image. Assuming that the texture of the surfaces of the rollers 44 and 45 are comparable, the first image will have a higher gloss than the second image.

This aspect of the FIG. 1 apparatus can be managed and even taken advantage of in forming the images. In many applications, it is more important for one image to be glossy than another. Although this concept is not limited to greeting cards, greetings cards are a particularly good example. Particularly sophisticated customized greeting cards may use more than one photo. Similarly, customization is also useful when no photos are being used. However, a very common and attractive utilization of customization in greeting cards involves the combination of a single photo with other greeting card graphics, including a customized message, a background and perhaps other decoration or drawings. In this last and very common situation, it is usually quite desirable to do the image containing the photo with as high a gloss as possible. The other image may be indifferent to gloss or even prefer a more matte finish. Thus, with the image forming apparatus shown in FIG. 1 in which one toner image receives more fusing heat than does the other toner image, it is important to choose which image to form first.

In its most basic sense, this feature can be utilized in an image forming apparatus that does not have a duplex path such as path 60 but in which duplex images are made by hand refeeding of the receiving sheet. In this case, the operator is given instructions to choose the image the operator prefers to be most glossy to form first. Then, the receiving sheet is removed from output tray 64 and placed in the top of paper supply 15 with the first image up. The receiving sheet then passes through the system again receiving the second image on the second side (downside in the paper supply) and the first image receives a second fusing that improves its gloss when it passes through the fuser.

The operator can be assisted in this process by an operator control panel (OCP) 90. For example, present operator control panels include display screens which will step-by-step lead an operator through a complex process with a copier or printer. If the operator decides to do duplex color with image forming apparatus 1, that information is input through OCP 90. OCP 90 then instructs the operator to compose first the image to have the highest gloss. After that image has been formed and fused, the operator is instructed to remove it from the output hopper 64 and place it first imageside faceup in paper supply 15 for copying a second side which the operator is advised is the "more matte" side. This basic instruction can be modified in many ways. For example, instead of suggesting that the glossy side be done first, the operator can be instructed to do the side with the photographic image first. The detail of the instruction would clearly depend on the expected sophistication of the operator.

FIG. 1 illustrates several alternative approaches to electronic image formation, each of which can be adapted to the other features of the apparatus. In its most basic form, the front end electronics are essentially the same as that on the Kodak ColorEdge 1550 Plus color copier, referred to above, and on other available commercial image forming apparatus. In this basic apparatus, the image is composed by hand for a color scanner 95, the output of which is used with minimal electronic manipulation to control laser 6 in image formation. A greeting card with a combination of photo, message and other graphics can be made on such apparatus by cutting and pasting with one side being input through color scanner 95 in a single operation. The prompting from OCP 90 mentioned above is appropriate to such an apparatus.

A more sophisticated approach is also shown in FIG. 1 using a workstation 74 and page composition electronics 72 for composing each multicolor image for feeding to laser control electronics 70. In this instance, the image combining techniques disclosed in the above U.S. Patent to Watkins et al are particularly usable to form images that combine messages, other graphics and photographic images into a single multicolor image. Again, suitable prompts to the operator at the workstation 74 suggesting that the image that is preferably most glossy be formed first, will assure the desired result with that image passing through fuser 40 twice. A preferred approach to such prompts would give the operator a choice between a glossy or a matte finish for the sides in question. One aspect of customization is to provide the customer with what he desires. In this instance, the customer may prefer to have the photographic image more matte and is the other image more glossy. In such a case, the photographic side would be made last.

The choice may also be made automatically or by default. In this embodiment, the page composition electronics necessarily contains information associated with the makeup of each of both images. If only one of the images contains information from color scanner 95, that fact is necessarily known to page composition electronics 72. Page composition electronics 72 can then feed that page to laser control electronics 70 first. Other priorities can also be used. If both images contain material from color scanner 95, page composition electronics can be programmed to determine which material from color scanner 95 makes up the largest portion of its image.

Another preference useful in some situations is to determine which image has the most large areas of a single color without detail. The extra fusing in making the first image glossy helps hide any grain shown in such areas. Thus, image analysis for such a characteristic is used to determine which image should be formed first. Sophisticated electronics is also available and can analyze a color image and distinguish the portion which has a photographic origin from the portion which is text or other graphics. Such image analysis could be used, not only in the more sophisticated approach using workstation 74 and page composition electronics 72, but also in the more basic approach in which the output of color scanner 75 is fed directly to laser control electronics and page composition is accomplished by cut and paste.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus particularly useful with a relatively stiff receiving sheet, said apparatus comprising:

means for forming a toner image on a receiving sheet including means for positioning the toner image on the receiving sheet with two non-image containing margins, one on each of opposite sides of the toner image, means for fixing the toner image to the receiving sheet, means for moving the receiving sheet in an intrack direction through a path in which it receives the toner image and the image is fixed by the fixing means, in which path said margins are parallel to the intrack movement of the receiving sheet, and means for controlling the position of the receiving sheet while in the path, said controlling means including means for engaging the side of the sheet containing the toner image in each of said margins.

2. Image forming apparatus according to claim 1 wherein the engaging means is a roller.

3. Image forming apparatus according to claim 1 wherein the engaging means is two rollers on a single shaft, one roller positioned to engage each of said margins.

4. Image forming apparatus particularly usable with a relatively stiff receiving sheet, said image forming apparatus comprising:

means for forming a series of toner images on an image member, a transfer member having a surface which is movable through an endless path, and means for holding a receiving sheet to the surface, for repeated movement in a direction through transfer relation with the image member to receive the series of toner images in registration, wherein the means for forming the series of toner images and the means for holding the receiving sheet are positioned to provide a margin on each side of the receiving sheet outside the toner image generally parallel to the direction of movement of the receiving sheet when held by the transfer member and the image forming apparatus futher includes engaging means including a pair of rollers for engaging the receiving sheet while it is held by the transfer member, one roller engaging each of said margins to hold the receiving sheet against the transfer member.

5. Image forming apparatus according to claim 4 wherein the transfer member is a transfer drum.

6. Image forming apparatus according to claim 4 wherein the transfer member is an endless belt.

7. Image forming apparatus particularly usable with receiving sheets having a variety of stiffnesses, said image forming apparatus comprising:

a transfer member to which a receiving sheet is held to receive multiple toner images as the receiving sheet moves through a transfer position, means for holding a receiving sheet to a surface of the transfer member, means for engaging a receiving sheet to separate the receiving sheet from the transfer member, and means for applying a corona to the receiving sheet to affect its releasability from the transfer member, and means for adjusting the corona between a first condition and a second condition, said first condition making separation of the receiving sheet easier and said second condition discouraging separation of the receiving sheet from the transfer member.

8. Image forming apparatus according to claim 7 wherein said image forming apparatus includes means for receiving a cartridge having a coding on it indicative of the stiffness of the sheets in the cartridge and means for setting the image forming apparatus to the second condition in response to sensing a cartridge having a coding indicating that stiff sheet is in the cartridge.

9. Image forming apparatus according to claim 7 wherein said corona applying means applies corona onto the receiving sheet as it leaves the transfer position, which corona has an AC component in its first condition and no AC component in its second condition.

10. Image forming apparatus according to claim 9 wherein said corona has a DC component in its second condition.

11. Image forming apparatus according to claim 9 wherein said corona applytng means also includes means for applying corona to a side of the transfer member opposite the surface to which the receiving sheet is held.

12. Image forming apparatus particularly useful with a relatively stiff receiving sheet, said apparatus comprising:

means for forming a toner image on a receiving sheet with the toner image positioned on the receiving sheet with at least one non-image containing margin, which means for forming includes an endless transfer member including means for holding the receiving sheet to the transfer member, which transfer member is movable through an endless path to move the receiving sheet repeatedly through a transfer position at which it receives a plurality of toner images in registration, said receiving sheet being moved by said transfer member in an intrack direction through a path in which said margin is parallel to the intrack movement of the receiving sheet, means for fixing the toner image to the receiving sheet, and means for controlling the position of the receiving sheet while in the path, said controlling means including means for engaging the side of the sheet containing the toner image in said margin while it is held to said transfer member to maintain contact of the receiving sheet to the transfer member.

* * * * *